US005957325A

United States Patent [19]

Montañez

[11] Patent Number: 5,957,325

[45] Date of Patent: Sep. 28, 1999

[54] APPARATUS FOR STORING AND DISPENSING DISPOSABLE DIAPERS

[76] Inventor: Nydia Montañez, 30 Shafer Pl., Apt. 4A, Hackensack, N.J. 07601

[21] Appl. No.: 08/975,038

[22] Filed: Nov. 18, 1997

[51] Int. Cl.[6] ..... B65G 59/00; A47F 1/04

[52] U.S. Cl. ..... 221/131; 221/281; 221/303; 312/42; 312/290

[58] Field of Search ..... 221/102, 131, 221/281, 283, 303, 63, 33, 199, 35; 312/35, 42, 60, 290; 40/722, 725, 312

[56] References Cited

U.S. PATENT DOCUMENTS

| | | | |
|---|---|---|---|
| D. 357,105 | 4/1995 | Reiland et al. . | |
| 953,471 | 3/1910 | Kuhn | 221/199 |
| 1,208,701 | 12/1916 | Trenner . | |
| 2,069,264 | 2/1937 | Morris | 221/35 |
| 2,226,626 | 12/1940 | Mann | 312/42 |
| 2,361,730 | 10/1944 | Avrick . | |
| 2,661,991 | 12/1953 | Petrecca | 221/283 |
| 2,738,898 | 3/1956 | Lee . | |
| 3,259,271 | 7/1966 | Bump . | |
| 3,265,246 | 8/1966 | Messenger | 221/283 |
| 3,456,842 | 7/1969 | Mierson | 221/33 |
| 3,747,802 | 7/1973 | Uroshevich | 221/63 |
| 3,881,632 | 5/1975 | Early et al. | 221/63 |
| 4,015,885 | 4/1977 | Baggaley | 312/42 |
| 4,170,325 | 10/1979 | Pawlowski . | |
| 4,491,242 | 1/1985 | Trinidad . | |
| 4,538,726 | 9/1985 | Pastva . | |
| 5,016,778 | 5/1991 | Reiland et al. . | |
| 5,044,522 | 9/1991 | Roig et al. | 222/108 |
| 5,255,817 | 10/1993 | Reiland et al. . | |
| 5,570,808 | 11/1996 | Tassoni | 221/63 |
| 5,713,146 | 2/1998 | Reeves | 40/722 |
| 5,755,180 | 5/1998 | Smith | 40/725 |

OTHER PUBLICATIONS

Four D Has a Family of Products for Today's Active Families, Four D. Incorporated (undated).

*Primary Examiner*—William E. Terrell
*Assistant Examiner*—Joe Dillon, Jr.
*Attorney, Agent, or Firm*—Cooper & Dunham LLP; Robert T. Maldonado

[57] ABSTRACT

An apparatus for storing and dispensing disposable diapers includes a rectangular frame with an inverted Y-shaped partition forming two compartments for holding a stack of diapers at an incline. Openings are formed in the side walls for dispensing the diapers and notches are provided to facilitate removal. A picture frame is provided on the front panel of the apparatus for holding photographs. The cover can be one piece with an attached container on top or two pieces hinged to the partition. A towel rack may be provided on the bottom of the apparatus for holding washcloths or towels.

20 Claims, 3 Drawing Sheets

APPARATUS FOR STORING AND DISPENSING DISPOSABLE DIAPERS

FIELD OF THE INVENTION

The present invention relates generally to the field of article dispensers, and, more specifically, to devices that store and dispense disposable diapers.

BACKGROUND OF THE INVENTION

It is well-known that babies require a lot of equipment for comfort and for care. Indeed, when a baby is born and moves into the nursery, it usually is not difficult to fill the room with all of the baby's necessities, such as the crib, the dresser, the changing table, the rocking chair, the toy chest, the toys, and the diapers. Newborn babies often require a diaper change every two hours, which adds up to twelve diapers a day, or eighty-four diapers per week. Consequently, there is a need for a place to store such disposable diapers so that they are readily accessible.

One common place to store diapers is in a diaper sack, which is a large cloth bag including a hanger at the top and a vertical opening in the front, in which the diapers are stacked. The diaper sack can be hung low from the side of the changing table, but it generally is large, bulky, unattractive and difficult to reach and use. Another common place to store diapers is in a basket, which can be placed on a shelf. Such a bakset, however, is not specifically designed for diapers, and, hence, is likely to be an improper size so that when it is filled with diapers there may be wasted space. Moreover, all diapers in the basket are on display, which can be unattractive, and a shelf must be readily accessible at a convenient location.

SUMMARY OF THE INVENTION

It is therefore an important or principal object of the present invention to provide an apparatus that facilitates the storing and dispensing of diapers, which also is attractive and will not detract from the decor of the room where such diapers are stored and used.

The foregoing objects are achieved, and the disadvantages of other devices overcome by providing an apparatus for storing and dispensing disposable diapers that includes a rectangular frame including front and rear panels of the same height, and side panels of a shorter height so as to form openings at the bottom of each side. An inverted Y-shaped partition is provided for dividing the interior space of the frame into two compartments. The upstanding portion of the partition is centrally placed and the base portions slant downwardly therefrom toward the sides of the frame. Diapers can be stacked in each compartment and easily removed. Slots may be provided in the sides to allow viewing of the contents. The cover may be one piece with a depending projection that is inserted into the frame and fits snugly therewith, or the cover may be two pieces hinged to the partition. A picture frame is attached to the front of the apparatus for holding photographs or other objects, and a towel rack may be provided on the bottom for hanging washcloths or other items.

BRIEF DESCRIPTION OF THE DRAWINGS

Further objects, features and advantages of the invention will become apparent upon review of the following detailed description of the preferred embodiments, taken in conjunction with the following drawings, in which.

DETAILED DESCRIPTION OF PREFERRED EMBODIMENTS

Figure 1:
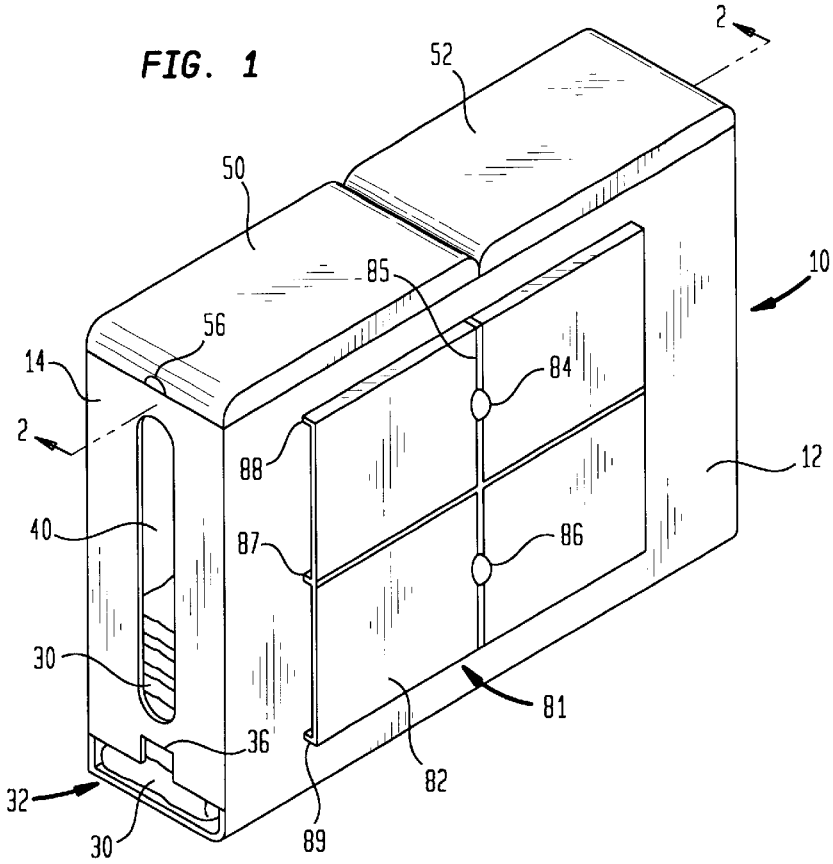
FIG. 1 is a perspective view of a diaper dispenser according to the present invention.
Figure 2:
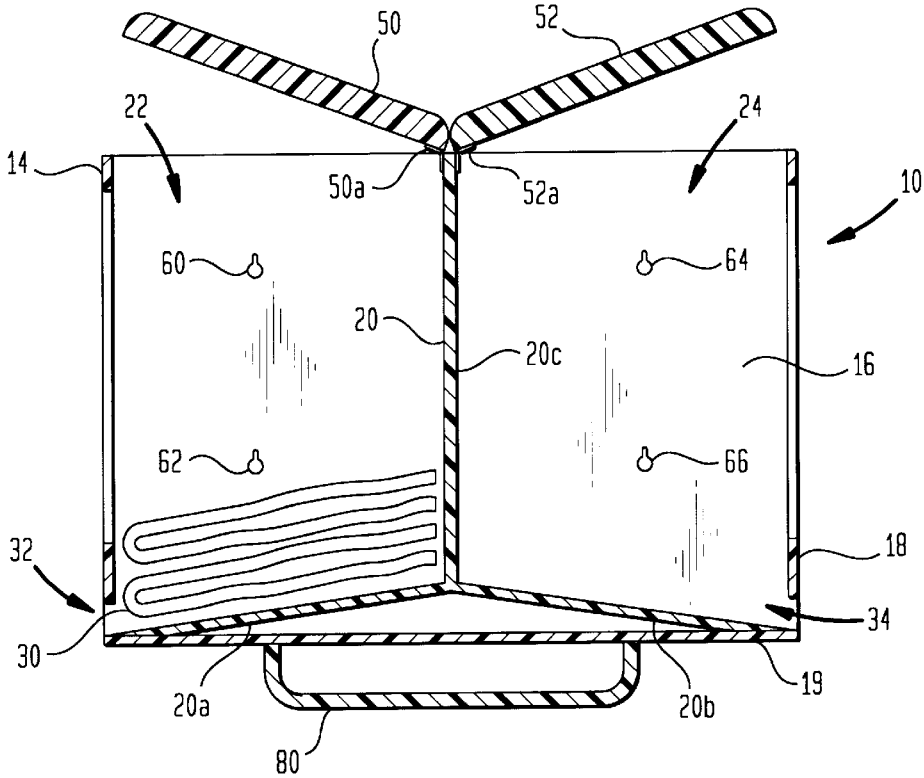
FIG. 2 is a front sectional view of the diaper dispenser of FIG. 1 taken along line 2—2 in FIG. 1 including a towel rack according to the present invention.

As shown in FIGS. 1 and 2, the diaper dispenser 10 is generally rectangular in shape and includes a front panel 12, a left side panel 14, a rear panel 16, a right side panel 18, and a bottom panel 19. The top of the dispenser 10 is open but may be covered with an openable cover as described below. The diaper dispenser 10 may be made of a hard plastic, wood, metal or any other suitable hard or soft material, including canvas or denim held on a frame. The interior space of the dispenser 10 is divided into two approximately equal compartments 22, 24 by an inverted Y-shaped partition 20. The base 20*a* of the left compartment 22 is sloped downward to the left, and the base 20*b* of the right compartment 24 is sloped downward in an opposite direction to the right. Each compartment 22, 24 has a length and width, approximately 9 inches by 5 inches, suitable to accommodate a disposable diaper 30, such as Pampers® or Huggies®. The overall height of the dispenser 10 is approximately 12 inches. The diapers 30 are stacked on top of each other at an incline in each respective compartment 22, 24 as shown in FIG. 2. Because the diapers 30 are soft and not rigid, they are not lodged against or supported by any of the vertical frame panels 12, 14, 16, 18 or the center partition 20*c*.

Each side panel 14, 18 is shorter than the overall height of the dispenser 10 and is positioned so as to align with the top of the dispenser 10 and to leave a respective opening 32, 34 at the bottom of each side. In addition, each side panel 14, 18 may include a notch 36, 38 at the center of its respective bottom edge. The opening 32, 34 is high enough so that a diaper 30 can fit therethrough, and the notch 36, 38 allows a finger or other object to be inserted to grasp and to pull out a diaper 30. The base portion 20*a*, 20*b* of each respective compartment 22, 24 is positioned at an angle of approximately 12.59 or more with respect to horizontal and is coated with a dry slippery substance, such as polyurethane or another suitable substance having a low coefficient of friction, to facilitate the removal of the diapers 30 from the dispenser 10.

The dispenser 10 may also be made of an opaque material, in which case each side panel 14, 18 may be provided with a longitudinal slot 40, 42, which may have an oblong shape, to allow a user to see how many diapers are left in the dispenser 10. Alternatively, the front panel 12 or the side panels 14, 18, or the entire dispenser 10 may be made of a transparent material, such as Plexiglas™, so that longitudinal slots 40, 42 are not necessary. Because the top of the dispenser 10 is upwardly open, diapers 30 can easily be reloaded into either compartment 22, 24 when the respective compartment becomes empty.

According to one embodiment, the cover includes a left cover 50 which covers the left compartment 22, and a right cover 52 which covers the right compartment 24. The left and right covers 50, 52 are attached to the dispenser 10 at the midpoint of the length of the dispenser 10 by respective hinges 50*a*, 52*a* which are attached to the center partition 20*c*. The outer unattached end of each half cover 50, 52 may be provided with a respective notch 56, 58 at a center portion thereof for inserting a finger to lift the respective cover. A handle or knob (not shown) may also be provided to assist the user in opening the covers 50, 52. The left cover 50 opens in a clockwise direction, and the right cover 52 opens in a counterclockwise direction. The covers 50, 52 rest in a closed position.

Figure 5:
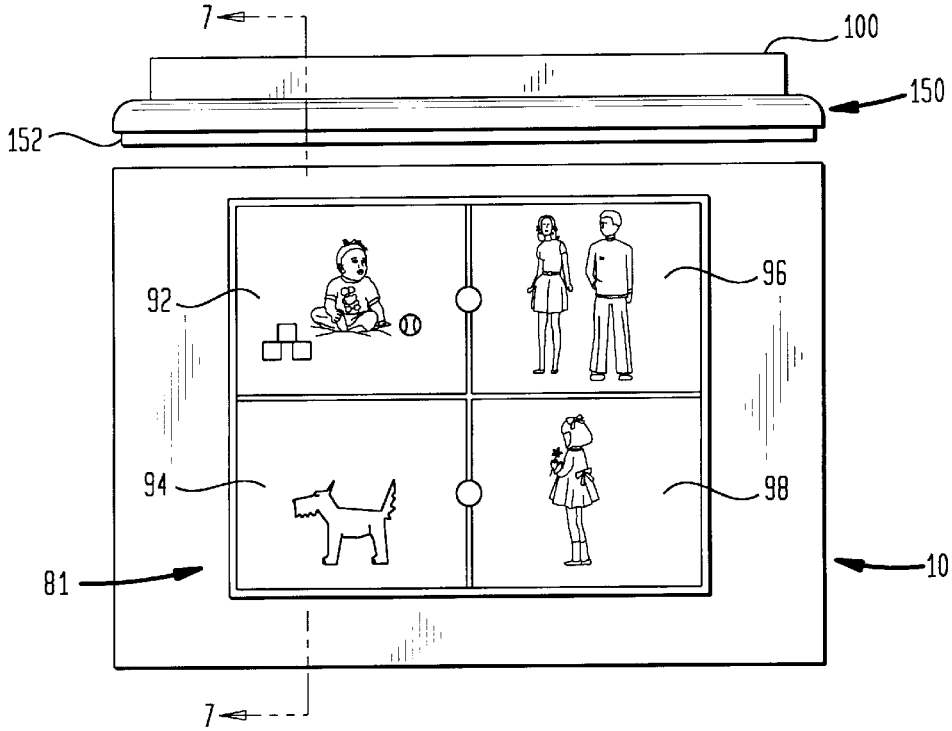
FIG. 5 is a front view of the diaper dispenser according to the present invention with a one-piece cover.
Figure 6:
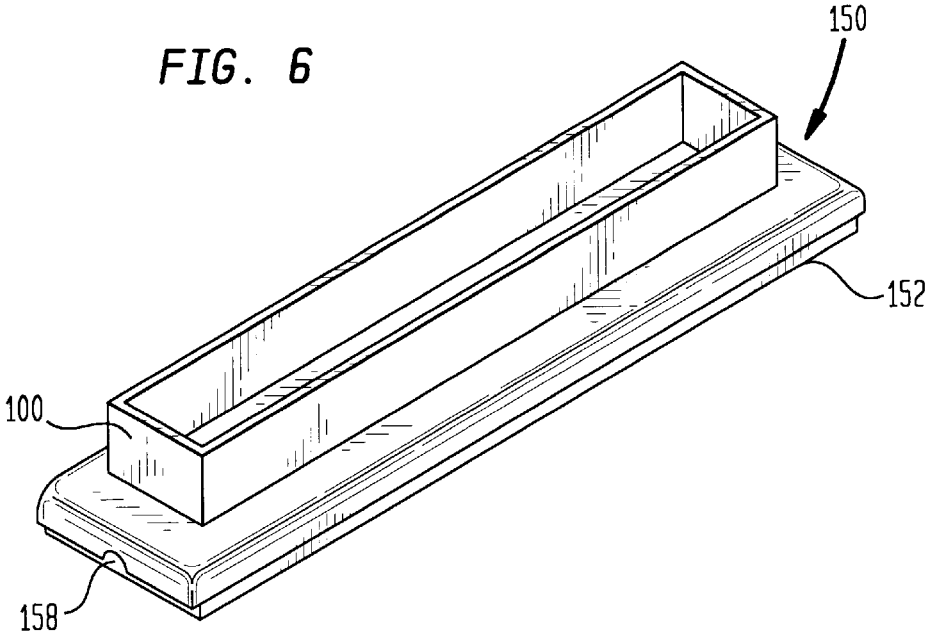
FIG. 6 is a perspective view of the cover for the diaper dispenser shown in FIG. 5.
Figure 7:
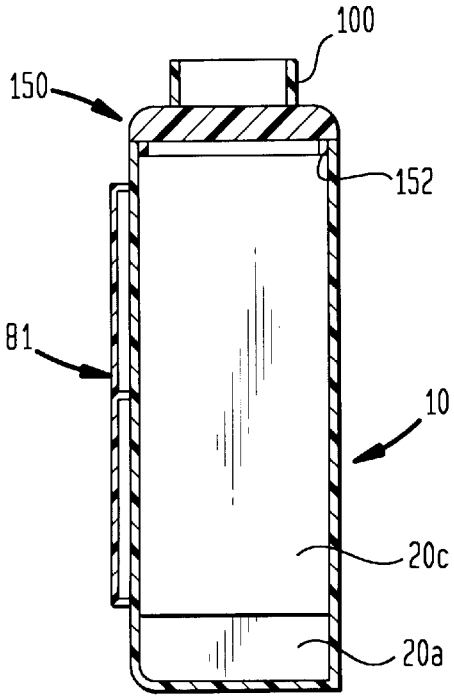
FIG. 7 is a side sectional view taken along lines 7—7 in FIG. 5.
Figure 8:
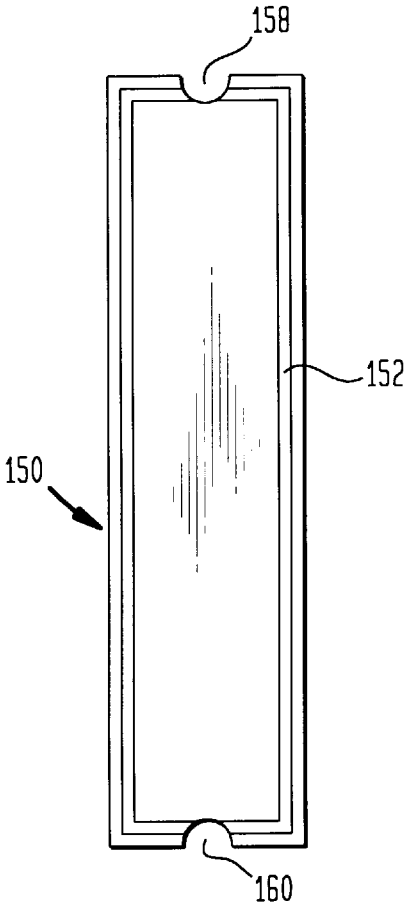
FIG. 8 is a bottom view of the cover shown in FIG. 6.

Alternatively, the cover 150 may be made of a single piece which is not attached to the dispenser 10. Instead, the underside of the one-piece cover 150 is provided with a depending ridge 152 which extends along the perimeter of the cover 150 as shown in FIGS. 5–8. The outer dimensions of the ridge 152 are sized to fit snugly with the inner dimensions of the dispenser 10 when the cover 150 is placed on the top thereof as shown in FIG. 7. The ends of the cover 150 may be provided with notches 158, 160 to allow a user to insert a finger thereunder to lift and to remove the cover 150. A handle or knob may also be provided to assist the user in lifting and removing the cover 150. While two methods of securing the cover to the dispenser 10 have been described, it is to be understood that the cover may be secured or attached by a variety of other means which would be considered within the ordinary level of skill.

Figure 3:
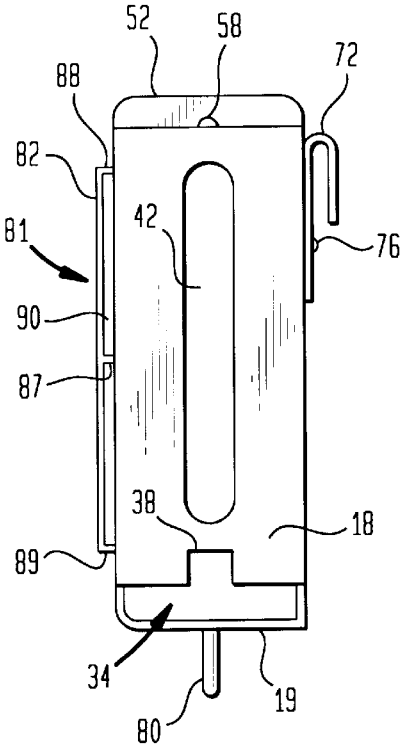
FIG. 3 is a side view of a diaper dispenser including a towel rack according to the present invention.
Figure 4:
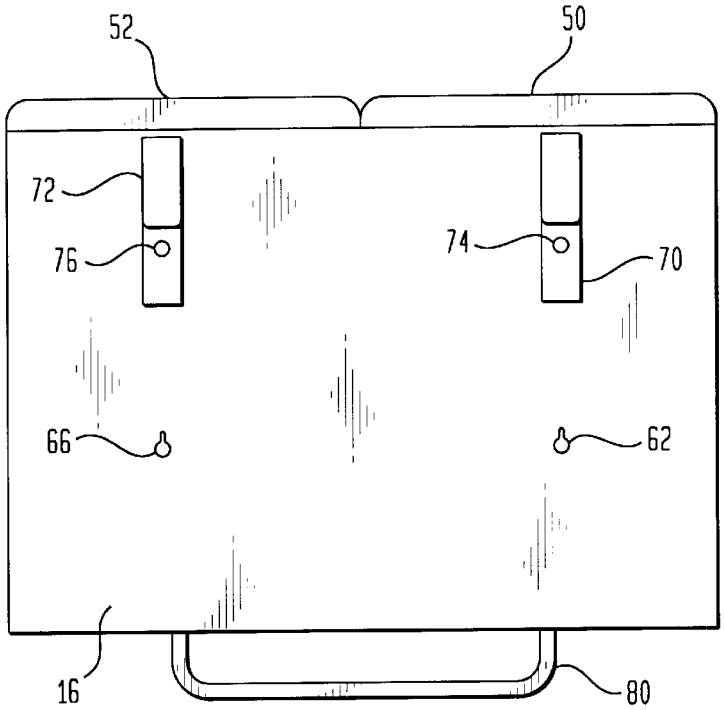
FIG. 4 is a rear view of the diaper dispenser including a towel rack according to the present invention.

The dispenser 10 may be set up in a variety of ways. For example, the dispenser 10 may be placed on a table or shelf or another flat surface. Alternatively, as shown in FIG. 2, the dispenser may be provided with a plurality of holes 60, 62, 64, 66 in the rear panel 16 thereof for receiving mounting screws or nails to mount the dispenser 10 on a wall or other structure. As shown in FIGS. 3 and 4, the dispenser 10 also may be provided with mounting brackets 70, 72 which may be attached to the rear panel 16 of the dispenser 10 by respective screws 74, 76 through mounting holes 60, 64. The mounting brackets 70, 72 also may be attached to the dispenser 10 with glue, epoxy or any other adhesive substance. The mounting brackets 70, 72 may have an inverted U-shape so that the dispenser 10 may be hung on a changing table or crib or other piece of furniture. In addition, the mounting brackets 70, 72 may be removable so that the dispenser 10 can be adapted to a variety of uses.

The dispenser 10 can be provided with a variety of features to make it more useful and/or attractive. As illustrated in FIG. 5, the front panel 12 of the dispenser 10 may be provided with a picture frame 81 made of clear acrylic or Plexiglas™ or another suitable material and including a front face 82 and an upper ridge 88 and lower ridge 89 depending therefrom. The picture frame 81 also may include a horizontal ridge 87 and a vertical ridge 85 to divide the frame 81 into four compartments, each capable of holding one photograph. Each of the ridges 85, 87, 88, 89 may be attached to the front panel 12 with glue, epoxy or any other adhesive. Alternatively, the picture frame 81 can be attached to the front panel 12 with any other conventional attachment means, such as a magnet, hooks or screws. In addition, the picture frame 81 may be removably attached, for example, with a hinge (not shown) so that it can be opened and closed with ease. The ridges 85, 87, 88, 89 are configured so as to form a gap 90 between the front face 82 of the picture frame 81 and the front panel 12 of the dispenser 10. The gap can be approximately ⅛ inch. The sides of the picture frame 81 are open so that photographs may be slid into the gap 90.

The picture frame 81 might be approximately 8 inches by 12 inches so as to accommodate four pictures that are 4×6 inches each, or the picture frame 81 may be any other size. The picture frame 81 may be provided with any number of apertures 84, 86 which will enable a user to insert a finger to slide the inserted photographs out of the picture frame 81. Therefore, a user can place photographs 92, 94, 96, 98 of the baby or of other family members or pets on the front face of the diaper dispenser 10 and also can rotate or replace the photographs from time to time.

A towel rack 80 may be attached to the bottom panel 20 of the dispenser 10, as shown in FIGS. 2 and 4. The towel rack 80 may have a U-shape and may be used to hang washcloths, hand towels or other articles therefrom. It may be attached to the dispenser 10 by any number of conventional attachment means, such as screws, glue, epoxy, or any other bonding substance. Also, a container 100 may be provided on the top of the one-piece cover 150 for holding supplies, such as diaper ointment, wipes, tissues, or the like. The container 100 can be rectangular in shape as shown in FIG. 6, and may be attached to the cover 150 by any conventional attachment means, such as glue, epoxy, or another bonding substance, or screws, magnets, or the like. The container 100 may be made of clear acrylic or plexiglass, or it may be an opaque colored plastic, or it may be wicker to resemble a basket.

Having described specific preferred embodiments of the present invention with reference to the accompanying drawings, it is to be understood that the invention is not limited to those precise embodiments, and that various changes and modifications may be effected therein by one skilled in the art without departing from the spirit or the scope of the present invention as defined in the appended claims.

What is claimed is:

1. An apparatus for storing and dispensing disposable diapers, comprising:

a plurality of panels forming a rectangular frame and defining an interior space, including parallel front and rear panels of approximate equal height, a first side panel and a parallel second side panel, and a bottom panel, the front and rear panels being connected by the first and second side panels and the bottom panel, wherein the first and second side panels are shorter in height than the front and rear panels so that a respective opening is formed on a first side and on an opposite second side of the apparatus for dispensing the disposable diapers, and wherein diapers may be reloaded in the dispenser from the top thereof; and an inverted Y-shaped partition disposed within the frame for dividing the interior space into a first compartment and a second compartment, for receiving a plurality of disposable diapers stackable in the first and second compartments at an incline, wherein the Y-shaped partition is formed as a unitary member and comprises a vertical divider extending downward from the center of the top but not extending to the bottom panel, so that the height of the divider is less than the height of the front and rear panels, and a first inclined base portion and a second inclined base portion extending downward from the bottom of the vertical divider toward the respective ends of the bottom panel, wherein the first and second inclined base portions are straight and extend from the front panel to the rear panel for substantial contact with the disposable diapers.

2. An apparatus as claimed in claim 1, wherein the first inclined base portion and the second inclined base portion are coated with a slippery substance to facilitate removal of diapers stored in the apparatus.

3. An apparatus as claimed in claim 1, further comprising viewing means formed in one of the first side panel and the second side panel for viewing the contents of the respective compartment.

4. An apparatus as claimed in claim 1, wherein the first and second side panels include a cut-out formed in a lower edge thereof adjacent the respective openings therein.

5. An apparatus as claimed in claim 1, further comprising a rack attached to the frame of the apparatus and horizontally disposed for receiving hanging objects.

6. An apparatus as claimed in claim 1, further comprising a cover for covering the top of the frame.

7. An apparatus as claimed in claim 1, wherein the first and second inclined base portions are positioned at an angle of 12.5 degrees from horizontal.

8. An apparatus as claimed in claim 1, further comprising mounting means for mounting the apparatus.

9. An apparatus as claimed in claim 8, wherein the mounting means comprises a hole formed in the rear panel of the frame.

10. An apparatus as claimed in claim 8, wherein the mounting means comprises a hook removably attached to the frame for hanging the apparatus.

11. An apparatus as claimed in claim 1, further comprising display means on the exterior of the front panel of the frame for holding an object such as a photograph, wherein the display means is formed of a single sheet of transparent material attached directly to the front panel.

12. An apparatus as claimed in claim 11, wherein the display means comprises a plurality of compartments, each holding a different object so that a plurality of objects may be displayed simultaneously.

13. An apparatus as claimed in claim 11, wherein the sheet of transparent material is displaced from the front panel of the frame so that the object can be held between the transparent sheet and the front panel.

14. An apparatus as claimed in claim 13, further comprising a projection formed on an inner surface of the sheet for displacing the sheet from the front panel of the frame or for holding the inserted object, wherein the projection is attached directly to the front panel.

15. An apparatus as claimed in claim 7, further comprising attachment means for removably attaching the sheet to the front panel of the frame.

16. An apparatus as claimed in claim 15, wherein the attachment means comprises a hinge attached to the sheet and to the front panel.

17. An apparatus for storing and dispensing disposable diapers, comprising:

a plurality of panels forming a rectangular frame and defining an interior space, including parallel front and rear panels of approximate equal height, a first side panel and a parallel second side panel, and a bottom panel, the front and rear panels being connected by the first and second side panels and the bottom panel, wherein the first and second side panels are shorter in height than the front and rear panels so that a respective opening is formed on a first side and on an opposite second side of the apparatus for dispensing the disposable diapers, and wherein diapers may be reloaded in the dispenser from the top thereof; and an inverted Y-shaped partition disposed within the frame for dividing the interior space into a first compartment and a second compartment, for receiving a plurality of disposable diapers stackable in the first and second compartments at an incline, and further comprising display means on the exterior of the front panel of the frame for holding an object such as a photograph, wherein the display means comprises a sheet of transparent material displaced from the front panel of the frame so that the object can be held between the transparent sheet and the front panel, and wherein the sheet contains at least one hole through which the inserted object can be manipulated.

18. An apparatus for storing and dispensing disposable diapers, comprising:

a plurality of panels forming a rectangular frame and defining an interior space, including front and rear panels, first and second side panels, and a bottom panel, the front and rear panels being connected by the first and second side panels and the bottom panel, wherein an opening is formed in the frame for dispensing the disposable diapers;

an openable lid rotatably attached to the frame for covering and uncovering the top thereof;

an inverted Y-shaped partition disposed within the frame for dividing the interior space into a first compartment and a second compartment, for receiving a plurality of disposable diapers stackable in the first and second compartments at an incline, wherein the Y-shaped partition is formed as a unitary member and comprises a vertical divider extending downward from the center of the top but not extending to the bottom panel, so that the height of the divider is less than the height of the front and rear panels, and a first inclined base portion and a second inclined base portion extending downward from the bottom of the vertical divider toward the respective ends of the bottom panel, wherein the first and second inclined base portions are straight and extend from the front panel to the rear panel for substantial contact with the disposable diapers; and a picture frame on the exterior of the front panel of the frame for holding objects such as photographs.

19. An apparatus as claimed in claim 16, wherein the cover comprises a first section and a second section each independently attached to the apparatus.

20. An apparatus as claimed in claim 19, wherein the first and second sections of the cover are attached to the apparatus with respective hinges.

* * * * *